US007515837B2

(12) United States Patent
Thacker et al.

(10) Patent No.: US 7,515,837 B2
(45) Date of Patent: Apr. 7, 2009

(54) SYSTEM AND METHODS FOR UNIVERSAL IMAGING COMPONENTS

(75) Inventors: William E. Thacker, Sanford, NC (US); Lynton R. Burchette, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 11/654,130

(22) Filed: Jan. 17, 2007

(65) Prior Publication Data

US 2008/0170866 A1 Jul. 17, 2008

(51) Int. Cl.
*G03G 15/00* (2006.01)

(52) U.S. Cl. ..... 399/12; 399/9; 399/24; 399/25; 399/111; 399/262

(58) Field of Classification Search ..... 399/12, 399/9, 24, 25, 262, 111
See application file for complete search history.

(56) References Cited

U.S. PATENT DOCUMENTS 5,235,384 A 8/1993 Oka
6,060,901 A 5/2000 Davis
6,339,684 B1 * 1/2002 Sato et al. ..... 399/12
6,498,905 B1 12/2002 Tsuruya
7,088,928 B2 * 8/2006 Burchette et al. ..... 399/12
7,136,608 B2 * 11/2006 Miller ..... 399/109
7,254,346 B2 * 8/2007 Burchette et al. ..... 399/12
7,257,335 B1 * 8/2007 Chan ..... 399/12
7,286,774 B1 * 10/2007 Miller et al. ..... 399/12

FOREIGN PATENT DOCUMENTS

JP 2003216005 7/2003
WO WO9852762 7/2008

* cited by examiner

*Primary Examiner*—David M Gray
*Assistant Examiner*—G. M. Hyder

(57) ABSTRACT

A universal cartridge chip for use with an imaging process cartridge installed in an imaging device is disclosed. The universal cartridge chip includes a memory storing imaging process cartridge data. The universal cartridge chip may be installed on the imaging process cartridge in a first orientation or a second orientation. If the cartridge chip is installed in a first orientation, the cartridge chip operates in a first mode. If the cartridge chip is installed in a second orientation the cartridge chip operates in a second mode.

22 Claims, 10 Drawing Sheets

SYSTEM AND METHODS FOR UNIVERSAL IMAGING COMPONENTS

FIELD OF INVENTION

The present invention relates to remanufacturing and modifying imaging process cartridges, such as printer toner cartridges, and more particularly to a system and techniques for providing a universal cartridge chip for an imaging process cartridge including a memory element adapted for use in multiple types of imaging process cartridges.

BACKGROUND

Imaging process cartridges such as toner cartridges are typically designed to fit into one type of laser printer or family of laser printers. For example, the same toner cartridge may be used in an HP4200 or HP4300 monochrome laser printer. As different printer models are introduced, the printer manufacturer may decide not to alter the physical characteristics of the toner cartridge but instead change some of the electronic components such as an electronic chip or cartridge chip on the imaging process cartridge instead. In one instance, the printer manufacturer may use a completely different chip on the same toner cartridge to differentiate between printer types. Alternatively, the printer manufacturer may employ the same cartridge chip but change the data stored within the cartridge chip. Even though a toner cartridge for use in one imaging device may use the same toner and all of the same operating components as an imaging process cartridge for another printer the cartridge chip may render it incompatible.

Typically, the printer communicates with the cartridge chip to access information stored within a memory component on the cartridge chip. The information stored on the cartridge chip may provide the printer with information relating to the yield of the imaging process cartridge, the printer type, type of toner (in the case of a color imaging process cartridge) and the like. The amount of information stored on the cartridge chip may be dependent upon the size of the memory resident on the cartridge chip.

Imaging process cartridges are typically designed to provide the consumer a certain number of print copies before the toner or ink is exhausted. The total number of prints varies depending on the type, quality and density of the print provided by the printer. The cartridge chip may be a "one time use" device. Thus, when the imaging process cartridge depletes its toner or ink to a predetermined level, the cartridge chip may cease to function. By limiting the cartridge chip to a single use, the Original Equipment Manufacturers (OEM's) may prevent the imaging process cartridge from simply being refilled with toner or ink and placed back into service. After all of the toner or ink is spent, the imaging process cartridges are either thrown away or recycled.

An emerging industry has developed That deals with the recycling of imaging process cartridges. Typically, the imaging process cartridge is recycled by an imaging process cartridge remanufacturer, who receives spent imaging process cartridges and refurbishes them. During the refurbishing of the imaging process cartridge, the imaging process cartridge is disassembled, cleaned, repaired and reassembled. Worn or broken components such as organic photoconductor (OPC) drums, wiper blades, cartridge chips and the like are generally repaired or replaced. The last steps of the refurbishment process typically include refilling and repackaging the refurbished imaging process cartridge, and distributing the refurbished imaging process cartridges into the marketplace.

In order to simplify the manufacturing or remanufacturing process, cartridge chips may be designed to be compatible with a variety of imaging process cartridge types. Accordingly, there exists a need in the industry to take advantage of the similar designs of a cartridge chips installed on various imaging process cartridges.

SUMMARY

The present disclosure recognizes this need and discloses an imaging process cartridge which uses a universal cartridge chip that may be installed and positioned in two or more orientations. The universal cartridge chip is able to detect its orientation and based on the orientation the imaging process cartridge may operate in different modes.

A method of operating an imaging process cartridge installed in an imaging device, the imaging process cartridge having a universal cartridge chip is disclosed. The method determines a physical orientation of the universal cartridge chip when the universal cartridge chip is mounted on the imaging process cartridge in a first position or a second position. The method configures the universal cartridge chip to operate in a first mode of operation if the universal cartridge chip is mounted in the first position. The method further configures the universal cartridge chip to operate in a second mode of operation if the universal cartridge chip is mounted in a second position.

A universal cartridge chip is disclosed. The universal chip has an input/output (I/O) circuit and a controller coupled to the I/O circuit. The controller also has an orientation determination circuit wherein the orientation determination circuit receives communication information from the I/O circuit. The universal cartridge chip determines if it is installed in a first orientation or a second orientation based on the communication information.

An imaging process cartridge for use in an imaging device is disclosed. The imaging process cartridge has a universal cartridge chip affixed on the imaging process cartridge. The universal cartridge chip has an orientation logic circuit, which causes the imaging process cartridge to operate in a first mode when the orientation logic circuit determines that the universal cartridge chip is mounted in a first orientation. The imaging process cartridge operates in a second mode when said when the orientation logic circuit determines the universal cartridge chip is mounted in a second orientation.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings, which illustrate specific embodiments of the invention. In the discussion that follows, specific systems and techniques for repairing, manufacturing or remanufacturing an imaging process cartridge, such as a toner cartridge are used as examples. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Within the printer industry, printer manufacturers have employed various techniques to differentiate between toner cartridges for use in the same or different printers. These techniques range from altering the physical dimensions and shape of the imaging process cartridge to changing the cartridge chip mounted on the imaging process cartridge. As new printer models are developed, "new" toner cartridges may also be introduced. In some cases, the new toner cartridge may contain exactly the same components and have the same general physical design as those of the previous printer model. However, the new toner cartridge may have a different cartridge chip installed. Changing the cartridge chip allows the printer manufacturer to differentiate between a previously introduced toner cartridge and those of newer printer models. This may allow the printer manufacturer to increase profit margins by charging the consumer a premium for the new toner cartridge.

In some color laser printers, the various toner cartridges may be identical with the exception of the color of toner and the cartridge chip. For example, within the HP2600 color laser printer there are no physical restrictions preventing the installation of a black toner cartridge in any of the other three toner cartridge locations (cyan, magenta or yellow). Even though the various toner cartridges fit interchangeably within a color laser printer, an error message may be displayed by the printer if a cyan toner cartridge is installed in the black toner location of the color laser printer. For example, in the HP2600 color laser printer, the error message "INCORRECT CARTRIDGE TYPE" is displayed by the printer when a black toner cartridge is inserted in the cyan toner cartridge location.

Figure 1:
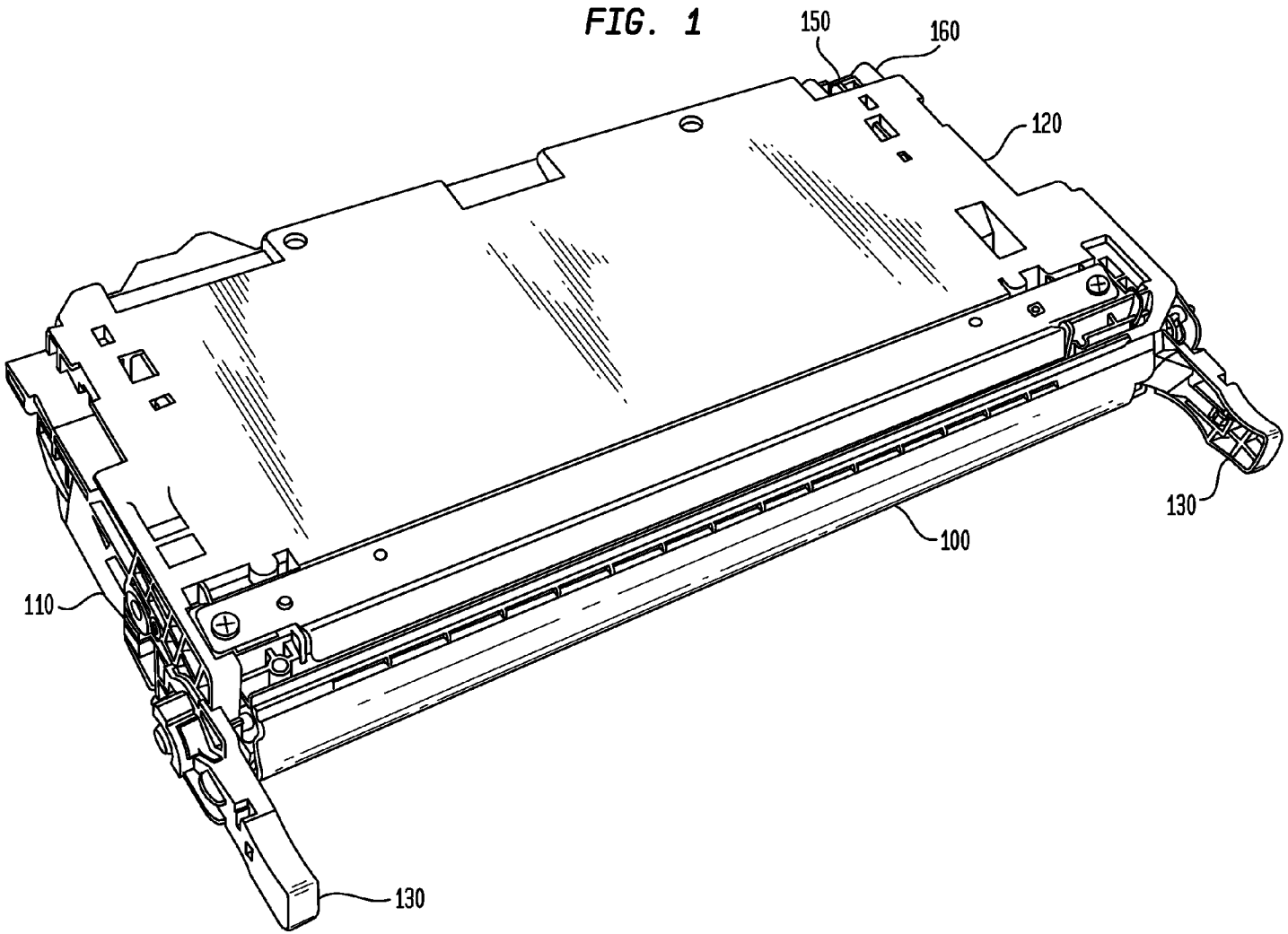
FIG. 1 shows a side perspective view of a fully assembled imaging process cartridge for use in the HP2600 color laser printer.

FIG. 1 displays a front perspective view of an exemplary toner cartridge 100 used in the HP2600 color laser printer. The toner cartridge 100 has a waste bin assembly 110 and a toner hopper assembly 120. On the sides of the toner cartridge 100 are handles 130 which may be used to facilitate the insertion and extraction of the toner cartridge 100 from the printer. Located within the toner hopper assembly 120 are various other components such as the magnetic roller, transfer roller, OPC drum (not shown) and the like. Mounted on an upper portion 160 of the toner cartridge 100 is a universal cartridge chip 150.

Figure 2A:
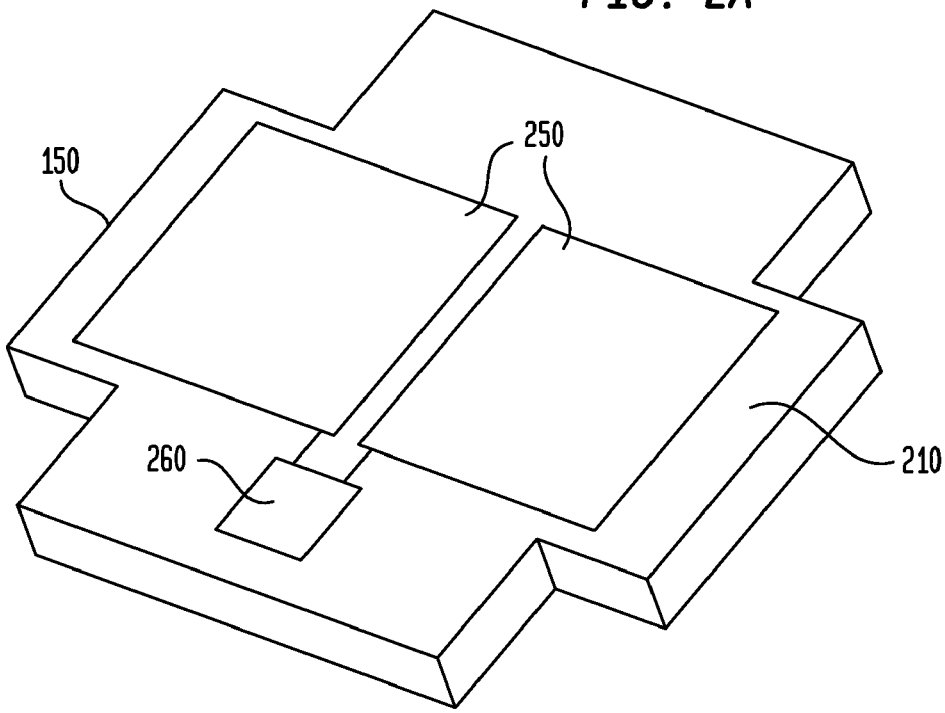
FIG. 2A displays a universal cartridge chip for use on the toner cartridge of FIG. 1 in accordance with one embodiment of the present invention.

FIG. 2A displays a side perspective view of the exemplary universal cartridge chip 150 which may be installed on the toner cartridge 100. The universal cartridge chip 150 may comprise a printed circuit board (PCB) 210 upon which electrical components may be mounted. As displayed in FIG. 2A, the universal cartridge chip 150 has an integrated circuit 260 which is electrically coupled to contacts 250 positioned on the PCB 210. The integrated circuit 260 may be an ASIC (Application Specific Integrated Circuit), programmable gate array, microprocessor, microcontroller or the like. In an alternative embodiment, the integrated circuit 260 may be replaced with multiple discrete components which may provide the same functionality as the integrated circuit 260. The functionality of the integrated circuit 260 is further described in the discussions of FIG. 4. The universal chip 150 of FIG. 2A only has contacts on one side of the PCB 210.

Figure 2B:
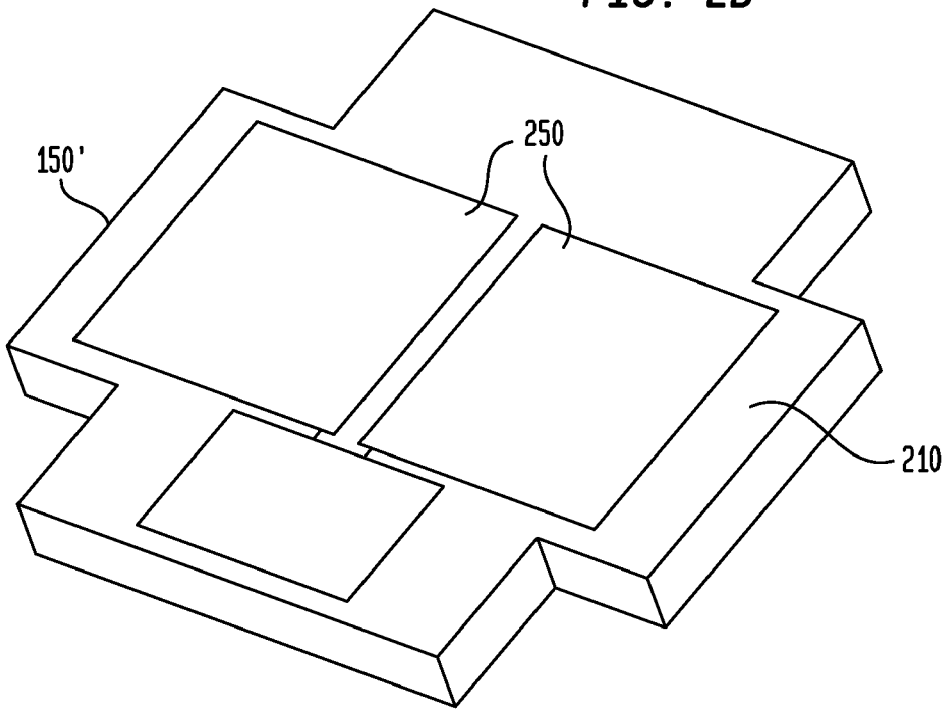
FIG. 2B displays a universal cartridge chip for use on the toner cartridge of FIG. 1 in accordance with an alternative embodiment of the present invention.

FIG. 2B displays a universal cartridge chip 150' in accordance with an alternative embodiment of the present invention. The universal cartridge chip 150' is similar to the universal cartridge chip 150 with the difference being the universal cartridge chip 150' has contacts 250 on both sides of the PCB 210. The contacts 250 on the back side of the universal cartridge chip 150' are electrically coupled to the integrated circuit 260.

Figure 3A:
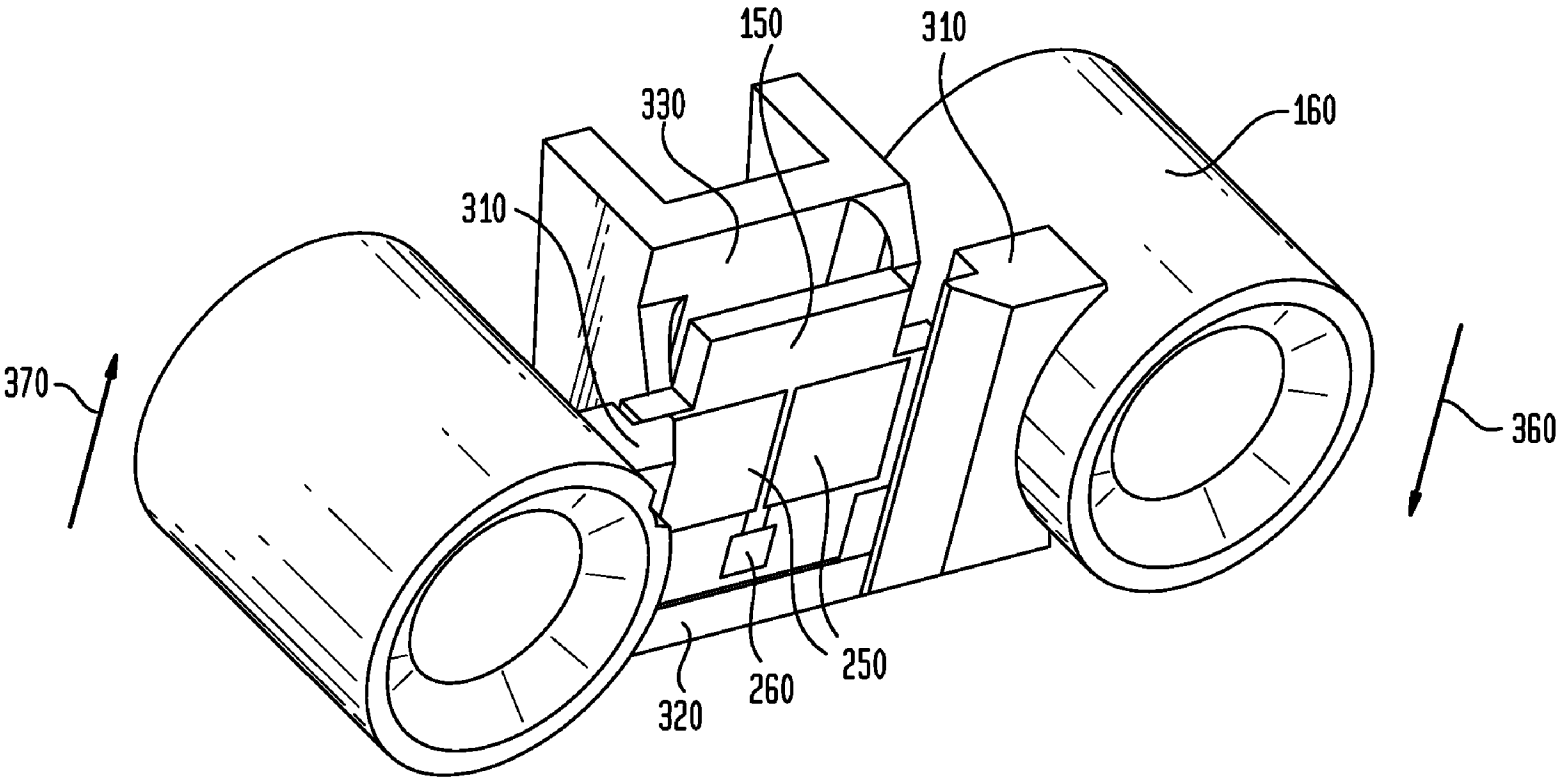
FIG. 3A shows a close up view of the universal cartridge chip of FIG. 2A installed in a first orientation in accordance with the present invention.
Figure 3B:
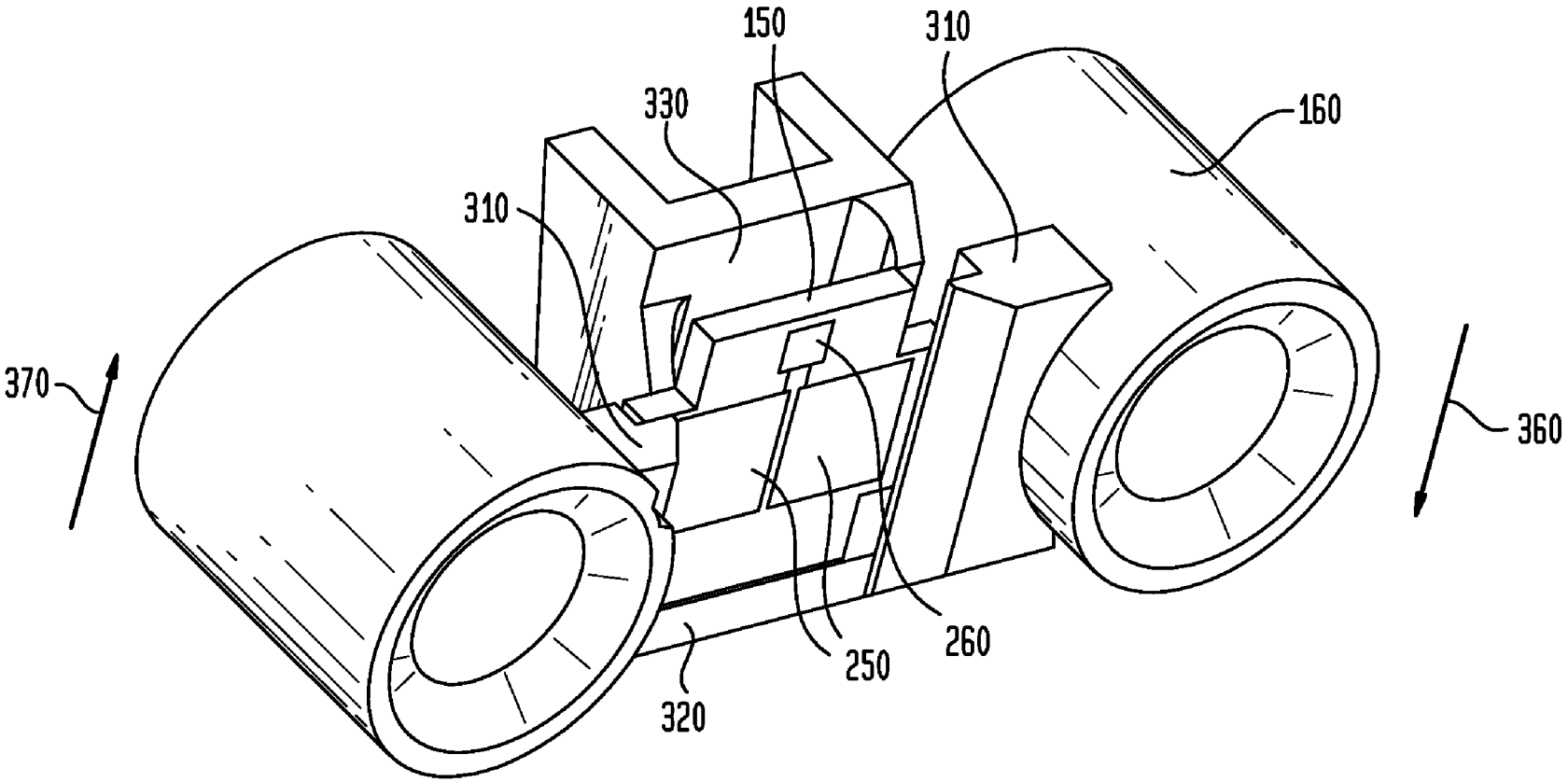
FIG. 3B shows a close up view of the universal cartridge chip of FIG. 2A installed in an alternate orientation in accordance with the present invention.
Figure 3C:
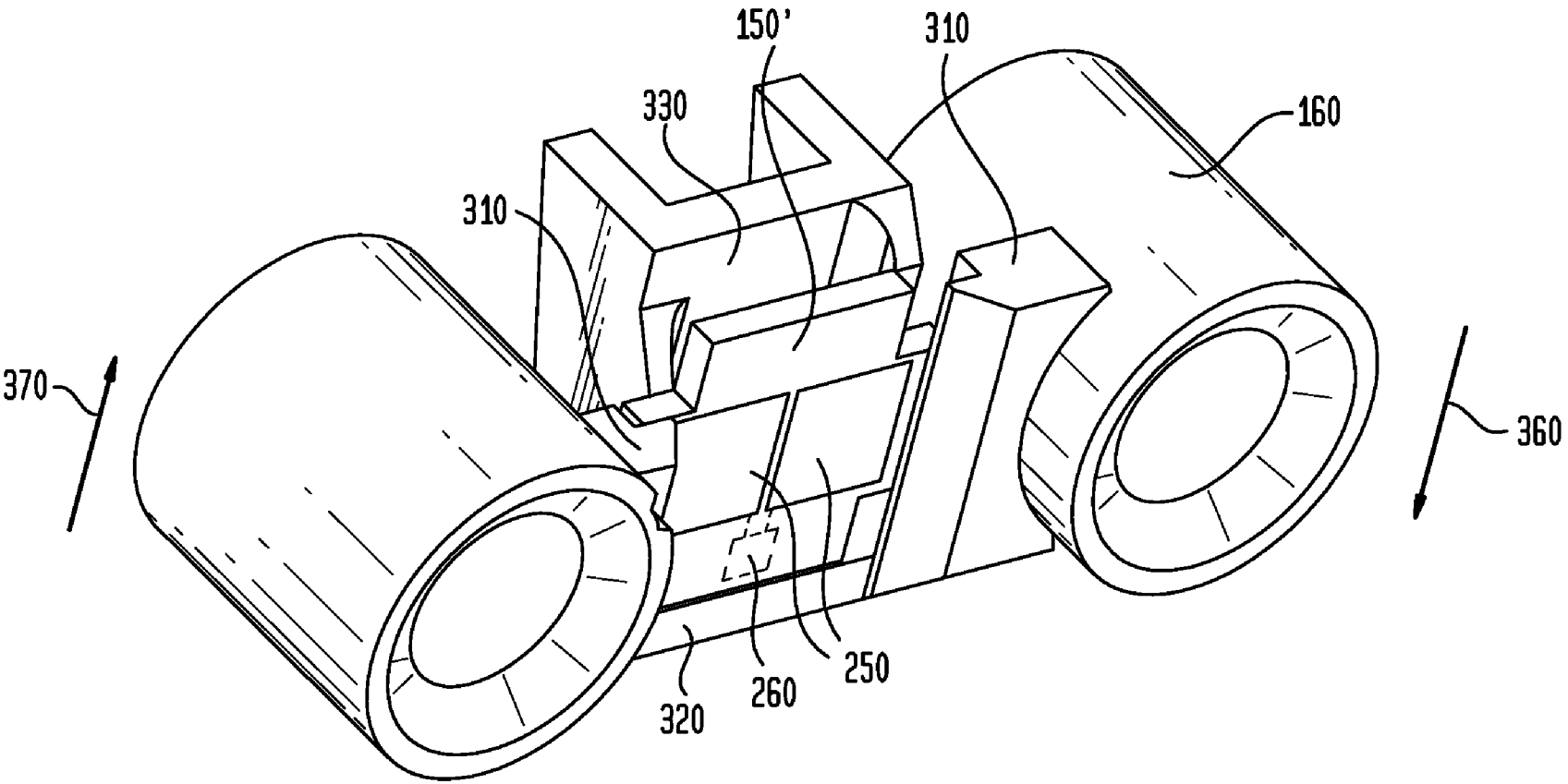
FIG. 3C shows a close up view of the universal cartridge chip of FIG. 2B installed in a first orientation in accordance with the present invention.
Figure 3D:
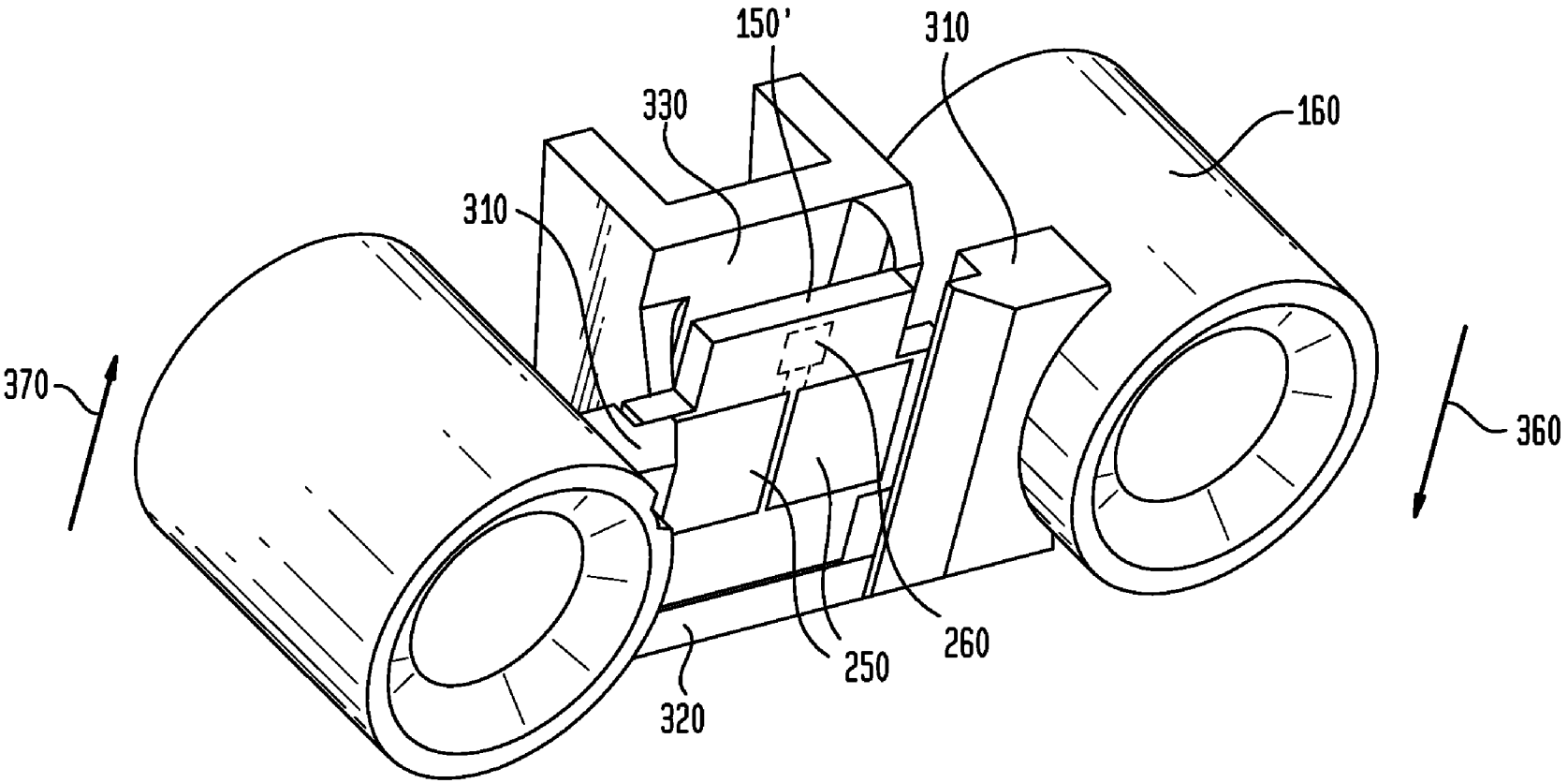
FIG. 3D shows a close up view of the universal cartridge chip of FIG. 2B installed in yet another orientation in accordance with the present invention.

FIGS. 3A and 3B display more detailed views of the upper portion 160 of the toner cartridge 100 with the universal cartridge chip 150 or 150' installed in different orientations. FIGS. 3C and 3D display the universal cartridge chip 150' mounted on the upper portion 160 in two alternative orientations. The universal cartridge chip 150 is discussed in reference to FIGS. 3A and 3B for illustrative purposes. Either the universal cartridge chip 150 or 150' may be installed in the embodiments of FIGS. 3A and 3B.

Referring to FIG. 3A, the universal cartridge chip 150 may be mounted over a mounting surface 330 and secured in place by two securing arms 310. The universal cartridge chip 150 may be installed by inserting the chip between securing arms 310 and sliding it in a downward direction 360 until the universal cartridge chip 150 rests against a securing edge 320. Removal of the universal cartridge chip 150 may be accomplished by sliding it in an upwards direction 370 away from the securing edge 320 until the universal cartridge chip 150 is clear of the securing arms 310. The universal cartridge chip 150 is installed on the toner cartridge 100 so the contacts 250 make an electrical connection with two electrical conductors (not shown) located within the toner cartridge compartment in the printer when the toner cartridge 100 is installed.

As shown in FIGS. 2A and 2B, the universal cartridge chip 150 or 150 may be symmetrically designed, allowing it to be mounted on the upper portion 160 in several different orientations. In the embodiment displayed in FIG. 3A, the universal cartridge chip 150 may be installed on the toner cartridge 100 with the integrated circuit 260 positioned away from the mounting surface 205 and next to the securing edge 220. In the alternative embodiment of FIG. 3B, the universal cartridge chip 150 may be rotated 180 degrees and installed on the toner cartridge 100 with the integrated circuit 260 positioned away from the securing edge 220. Depending on the design of the universal cartridge chip 150, the functionality of the universal cartridge chip 150 may be determined by the location of an on chip jumper or other the placement of other component on the PCB 210.

As mentioned previously, the universal cartridge chip 150' may have contacts 250 on both sides of the PCB 210 electrically coupled to the integrated circuit 260. The universal cartridge chip 150' may be installed on the toner cartridge 100 in two additional orientations, mirroring the orientations displayed in FIGS. 3A and 3B. In FIG. 3A the universal cartridge chip 150 is mounted with the integrated circuit 260 facing away from the mounting surface 330, while in FIG. 3C, the universal cartridge chip 150' is flipped over and installed with the integrated circuit 260 facing the mounting surface 330 and next to the securing edge 320. In order to fit in the orientation as displayed in FIG. 3C, there needs to be enough clearance between the mounting surface 330 and the height of the integrated circuit 260 as it protrudes away from the PCB 210.

In an alternative embodiment, the universal cartridge chip 150' may be rotated 180 degrees from the orientation shown in FIG. 3C and installed on the toner cartridge 100 as displayed in FIG. 3D. In the orientation as displayed in FIG. 3D, the universal cartridge chip 150' may be installed with the integrated circuit 260 positioned towards the mounting surface 330 and away from the securing edge 320.

For ease of illustration, the functionality of the universal cartridge chips 150 and 150' are discussed using universal cartridge chip 150 as an illustrative example. The functionality of universal chip 150' mirrors that of universal chip 150 with the added task of monitoring all four contacts 250. This is discussed in greater detail in subsequent paragraphs.

Figure 4:
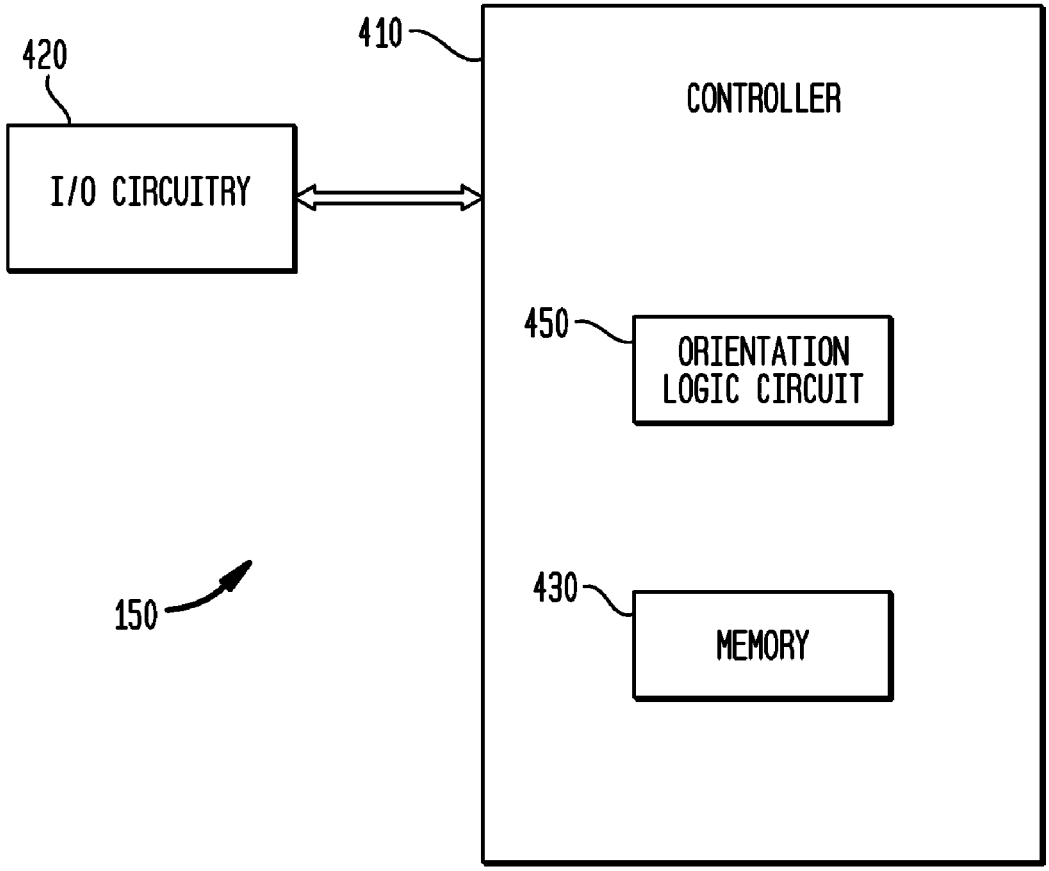
FIG. 4 displays a logic block diagram of a universal cartridge chip in accordance with the present invention in accordance with the present invention.

A functional block diagram 400 of the universal cartridge chip 150 is displayed in FIG. 4. As shown in the functional block diagram 400, the universal cartridge chip 150 has a controller 410 coupled to I/O circuitry 420. Within the controller 420 are a memory 430 and an orientation determination circuit 450. The controller 410 controls the operation of the universal cartridge chip 150 and provides a functional interface to the memory 430. The memory 430 may store information received from the printer or information to be sent to the printer. Some examples of data stored in the memory 430 may include printer type, color of toner installed in the imaging process cartridge, imaging process cartridge serial number, the number of revolutions performed by the organic photo conductor (OPC) drum, the manufacturing date, the number of pages printed (page count), percentage of toner remaining, yield (expected number of pages), toner-out indicator, toner low indicator, and the like. The orientation determination circuit 450 is used by the controller to determine the orientation of the universal cartridge chip 150 when it is installed on the imaging process cartridge.

Different printers may utilize various communications techniques to communicate with the cartridge chips on the toner cartridges. The I/O circuitry 420 contains the various components necessary to provide the communication interface between the controller 410 and the printer. In some toner cartridges, communication information may be sent to and from the printer using electrical signals. In the present invention, the communication information may also be referred to as data. In the universal cartridge chip 150 of FIG. 2, the I/O circuitry 420 comprises the contacts 250 and associated circuitry necessary to receive and transmit the electronic signals sent to and from the printer When data is sent by the printer to the universal cartridge chip 150, the controller 410 receives the data signals from the I/O circuitry 420. The data is then decoded and interpreted by the controller 410. After interpreting the data, the controller 410 has deciphered the information sent by the printer and the controller 410 performs the requested function.

One exemplary function performed by the controller 410 may be to receive a read instruction from the printer, access a location in memory 430, read the data stored at the location in the memory 430 and send the data back to the printer. Additionally, the printer may instruct the controller 410 to write a different value to the location in the memory 430 which may have been previously read. Alternatively, the controller 410 may be required to monitor certain conditions on the toner cartridge 150 and report these conditions to the printer when requested.

The HP2600 color laser printer communicates with the universal cartridge chip 150 by sending a data and clock signal through the contacts 250. The data comprises a pulse width modulated (PWM) data stream. The clock and data signals are extracted and formatted by the I/O circuitry 420 and are presented to the orientation circuitry 450 to determine the orientation of the universal cartridge chip 150. The output of the orientation circuitry 450 is then sent to the controller 410 to make the final determination of the universal cartridge chip orientation. When the data is sent from the universal cartridge chip 150 to the printer, the I/O circuitry 420 is used by the controller 410 to reverse the process and embed the data in the modulated PWM data stream.

Figure 5:
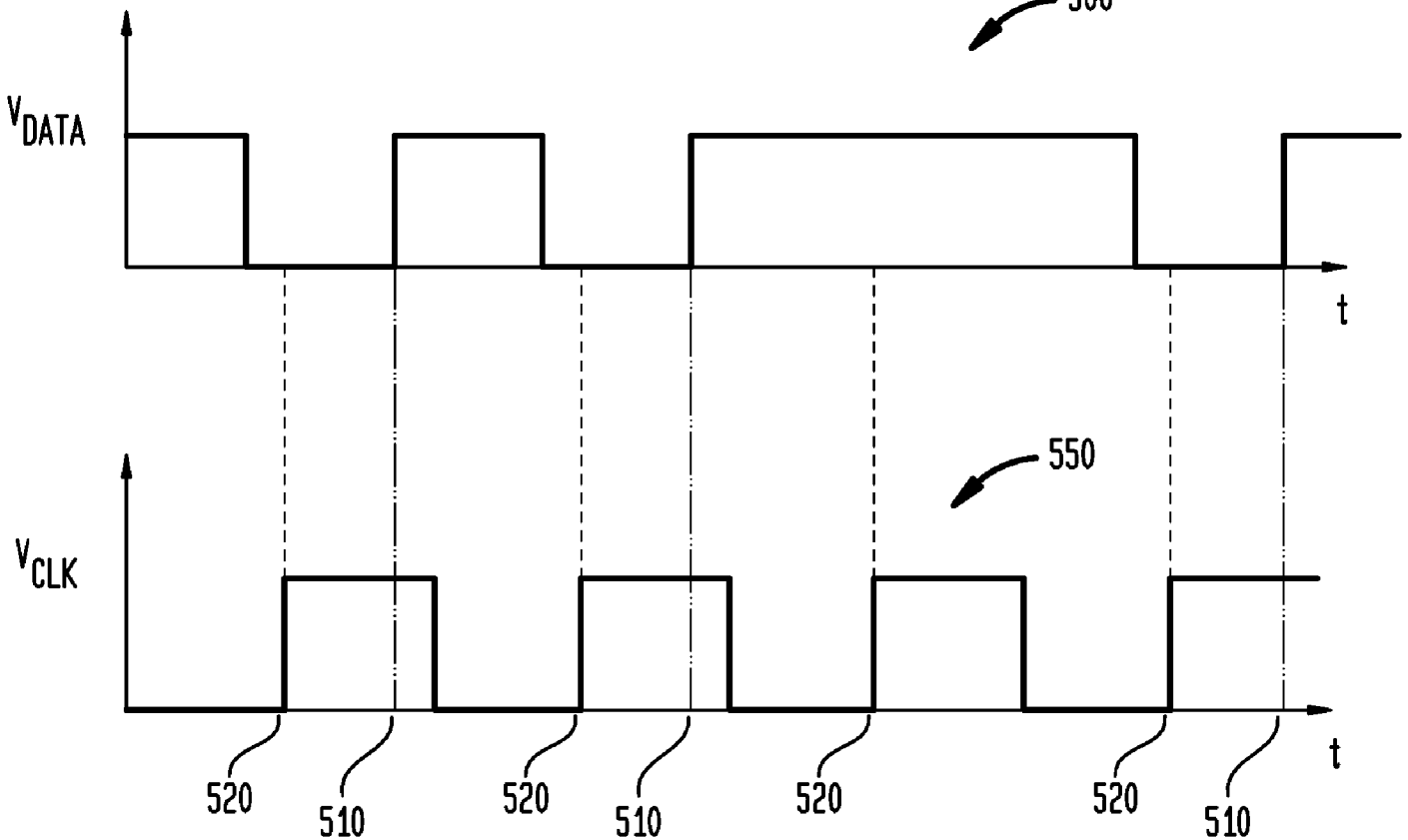
FIG. 5 displays a timing diagram of electronic signals processed by the universal cartridge chip of FIG. 3 in accordance with the present invention.

Exemplary data and clock waveforms 500 and 550 respectively, sent by the HP2600 color laser printer to the universal cartridge chip 150, are displayed in FIG. 5. The data waveform 500 and clock waveform 550 display the voltage waveform as it appears at each of the contacts 250. The two waveforms 500 and 550 are shown with the X-axis defined as the time period (t) and the Y-axis defined as the voltage levels (V). For the HP2600 color laser printer, the voltage levels are about 3.9 Volts and the period for the clock signal is around 100 KHz.

In order for the universal cartridge chip 150 or 150' to function in the various orientations (as previously described regarding FIG. 3A and FIG. 3B), the controller 410 must be able to determine in which position the universal cartridge chip 150 or 150' has been installed. Since the printer's electrical contacts remain constant, the controller 410 determines which of the contacts 250 on the universal cartridge chip 150 is receiving the data signal and which contact 250 is receiving the clock signal. This determination is typically performed by the orientation logic circuit 450 when the toner cartridge 100 is first installed into the printer. The printer may send a query message to the toner cartridge 100 and wait for a response. The controller must be able to receive and decode the message. If the controller does not respond within a predetermined amount of time, the printer may determine that an error has occurred and disable the toner cartridge 100.

Figure 6A:
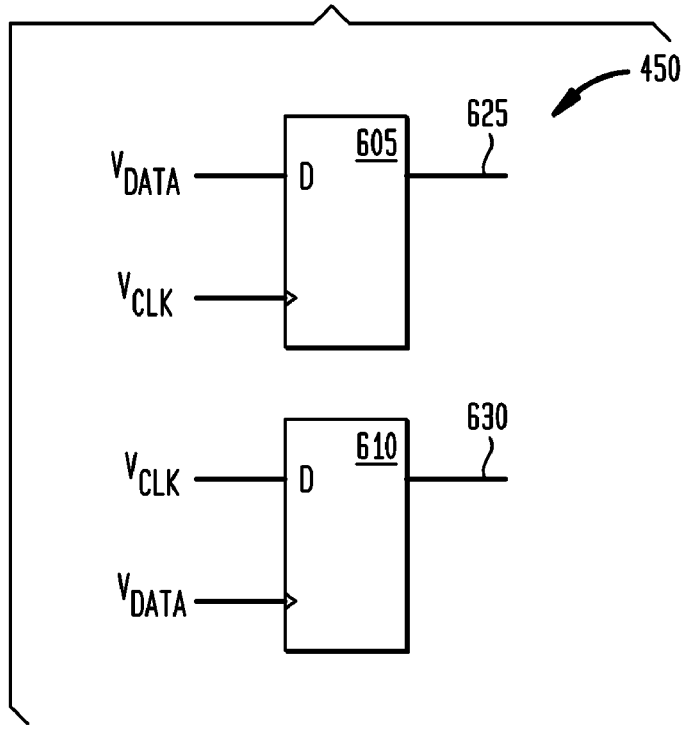
FIG. 6A displays an orientation logic circuit in accordance with one embodiment of the present invention.

FIG. 6A displays exemplary orientation logic circuitry 450 for a universal cartridge chip 150. The controller 410 uses the orientation logic circuitry 450 to determine which contact 250 is receiving the data signal and which contact 250 is receiving the clock signal.

In a preferred embodiment, the orientation logic circuit 450 has two D flip-flops 605 and 610. The electrical signal from each of the contacts 250 is distributed to the D and clk inputs of the flip-flops 605, 610. In this example, flip-flop 605 receives the electrical signal from the data pulses at the D input and the clock pulses are coupled to the CLK input. Flip-flop 610 receives the electrical signal from clock pulses at the D input and the data pulses at the CLK input. The output 625 of flip-flop 605 and the output 630 of flip-flop 610 are sent to the controller 410. The controller monitors the outputs (625 and 630) to determine which flip-flop (605 or 610) has the data pulses connected to the D input and the clock pulses connected to the clk input.

In the HP2600 color laser printer the period of the data pulses are typically shorter than the period of the clock pulses. Because the data pulses have a shorter width than the clock pulses, the rising edge of the data pulses will lead the rising edge of the clock pulses. The rising edges of the data pulses are displayed at 520 in the timing diagram 500 of FIG. 5. Conversely, the rising edge of the clock pulses will lag the data pulses and are shown at 510. Due to this characteristic, the flip-flop which receives the data pulses at the clk input will always have an output of a "1." In the orientation logic circuit 450, flip-flop 610 is connected in this fashion and will always have an output 630 of "1."

Flip-flop 605 is connected to the proper signals (i.e. data signals are transmitted to the D input and the clock signals are transmitted to the clk input). Thus, the output 625 will eventually transition to a "0" at some point in the data transmission sequence. Referring to the voltage waveforms 500 and 550, this may occur after the first rising clock pulse 520.

After the controller 410 has determined which output (625 or 630) of the flip-flops (605 or 610) has transitioned to a "0", the controller 410 may initialize the toner cartridge to perform in one or more operational modes. The modes of operation may relate to the orientation of the installed universal cartridge chip 150. For example, if output 625 transitions to a "0," the controller 410 may determine that the contact 250 coupled to the input of flip-flop 605 is transmitting the data signals and the contact 250 coupled to the clk input of flip-flop 605 is transmitting the clock signals. In this example, the universal cartridge chip 150 may be installed in the orientation as shown in FIG. 3A.

When the controller 410 has made this determination, the controller 410 may then configure the toner cartridge 100 to operate in a particular mode of operation. In one embodiment, the mode of operation may correspond to the color of toner in the toner cartridge 100. For example, in one mode of operation the controller 410 may cause the toner cartridge 100 to function as a black toner cartridge. In this embodiment, the controller 410 may access a location in memory 430 where a value corresponding to a black toner cartridge is stored. The controller 410 sends this value to the printer in order to allow the toner cartridge to function in the black toner cartridge location in the printer. If the controller 410 does not relay the black toner data to the printer (when the toner cartridge 100 is installed in the black toner cartridge location in the printer) the printer may not recognizing the toner cartridge 100 as being a black toner cartridge and may disable the toner cartridge 100. Alternatively, the controller 410 may cause the toner cartridge to function as a cyan, yellow or magenta toner cartridge. The controller 410 may access a location in memory 430 corresponding to the particular color (cyan, magenta or yellow) and send the particular value to the printer.

Referring back to FIG. 6A; if output 630 from flip-flop 610 transitions to a "0," the controller 410 may determine that the universal cartridge chip 150 may be installed in a second orientation, i.e. the orientation as displayed in FIG. 3B. If the controller 410 determines that the universal cartridge chip 150 is installed in a second orientation, the controller 410 may configure the toner cartridge 100 to operate in a second mode of operation, different than the first mode of operation (corresponding to the first orientation as shown in FIG. 3A). In the second mode of operation, the controller 410 may configure the toner cartridge 100 to operate as a black, cyan, yellow or magenta cartridge. For example, if the controller 410 configures the toner cartridge 100 to operate as a black toner cartridge when the universal cartridge chip 150 is installed in a first orientation, the controller 410 may configure the toner cartridge 100 to operate as a cyan, magenta or yellow toner cartridge when the universal cartridge chip 150 is installed in the second orientation. Using this technique, the toner cartridge manufacturer or remanufacturer may be able to introduce one universal cartridge chip 150 that based on its orientation, will cause the toner cartridge 100 to operate in one of several modes.

Figure 6B:
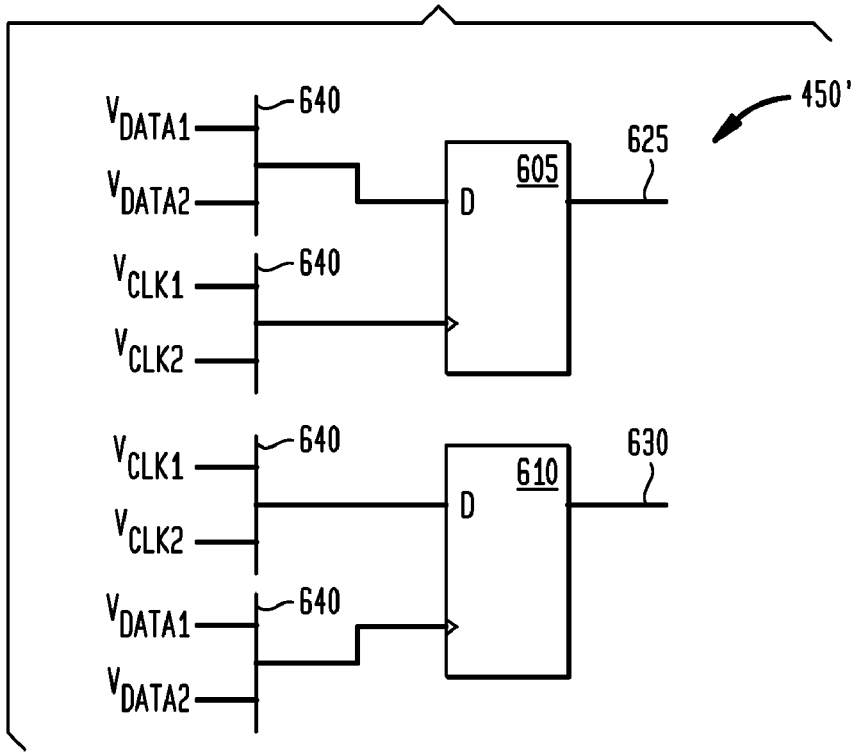
FIG. 6B displays a second orientation logic circuit in accordance with an alternative embodiment of the present invention.
Figure 6C:
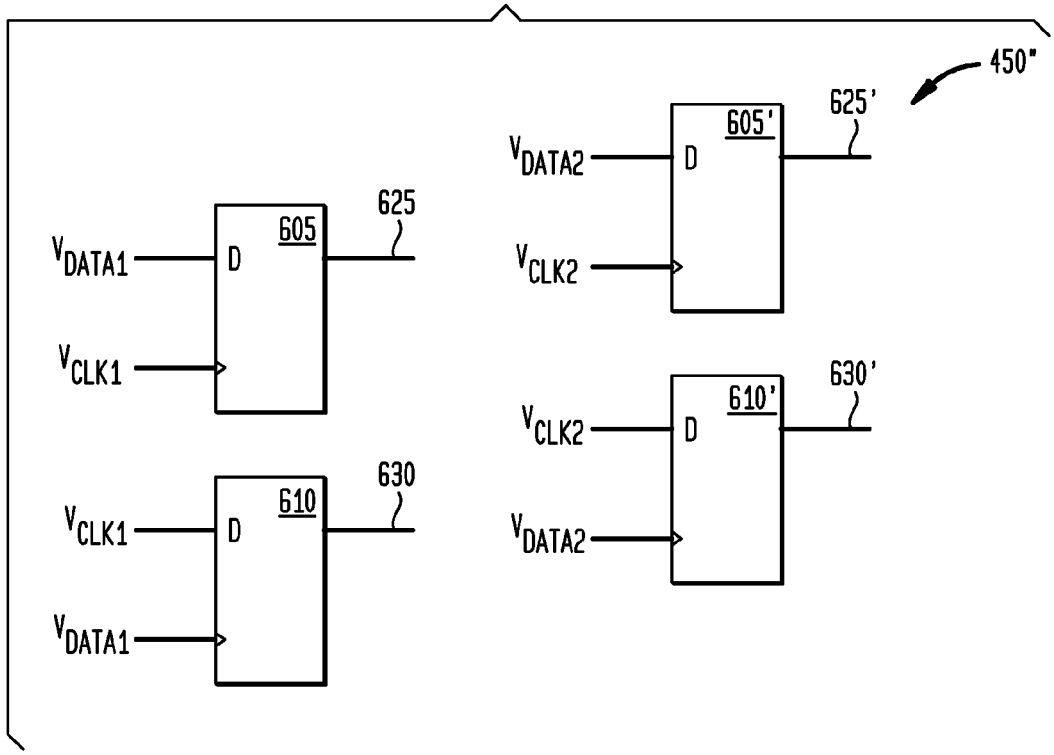
FIG. 6C displays a third orientation logic circuit in accordance with yet another embodiment of the present invention FIG. 7 displays an alternative universal cartridge chip used on the HP4200 or HP4300 toner cartridge in accordance with an alternative embodiment of the present invention.

If the universal cartridge chip 150' were installed on the toner cartridge 100 as shown in FIGS. 3C and 3D, an alternative orientation logic circuit 450' or 450" as displayed in FIG. 6B or 6C respectively may be used. FIG. 6B displays an orientation logic circuit 450' used by the universal cartridge chip 150' for determining its orientation. The orientation logic circuit 450' has four muxes 640 for selecting the active pair of contacts 250. The controller 410 may initially monitor the contacts to detect any activity. After determining that one of the two pair of contacts is transmitting data, the controller 410 may enable the corresponding inputs of the muxes 640. The orientation of the universal cartridge chip 150' is then determined as previously described. By determining which contacts 250 are active as well as the orientation of the active contacts, the controller 410 may configure the toner cartridge 100 to operate in one of four possible modes. As previously described, the modes of operation may relate to the specific color of toner present in the toner cartridge 100.

In yet another alternative embodiment as displayed in FIG. 6C, the universal cartridge chip 150' may have orientation logic circuit 450" using two sets of flip-flops (605 & 610, 605' & 610'). One set of flip-flops 605, 610 are connected to a one pair of contacts 250 receiving $V_{data1}$ and $V_{clk1}$. The other pair of flip-flops 605' and 610' are connected to the other pair of contacts 250 receiving the other signals $V_{data2}$ and $V_{clk2}$. In this embodiment, the controller 410 would monitor the outputs of all four flip-flops (625, 630, 625' and 630') to determine which pair is active. The controller 410 makes this determination by detecting which output of the flip-flops (625, 630, 625' and 630') transitions to "0." Once the controller determines which contact 250 is receiving the data signals (as previously described), the controller 410 determines the orientation of the universal cartridge chip 150' and configures the toner cartridge 100 to operate in one of four possible modes.

Utilizing one universal cartridge chip 150 or 150', the manufacturer or remanufacturer may simplify the manufacturing or remanufacturing process by reducing the number of chips required to support multiple imaging process cartridges. Instead of stocking individual cartridge chips for each color toner cartridge, the manufacturer or remanufacturer may need only one universal cartridge chip 150' to support all four color toner cartridges for the same printer.

Figure 7:
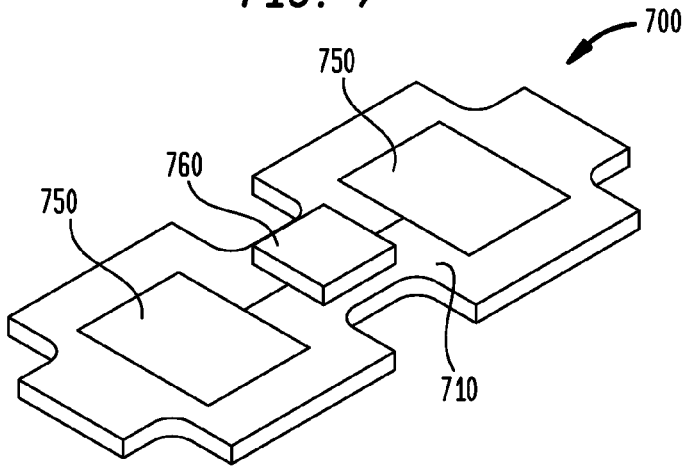

FIG. 7 displays a universal cartridge chip 700 used in the HP4200 or HP4300 monochrome laser printers. The universal cartridge chip 700 has contacts 750 mounted on a PCB 710. Also mounted on the PCB 710 is an integrated circuit 760. The integrated circuit 760 may contain logic circuitry similar to that described in the logic block diagram of FIG. 4. As displayed in FIG. 7, the universal cartridge chip 700 may be symmetrical allowing the universal cartridge chip 700 to be mounted in several orientations. Additionally, the universal cartridge chip 700 may have contacts 750 on both sides of the PCB 710.

If the universal cartridge chip 700 has contacts on both sides of the PCB 710, the controller 410 may be able to configure the toner cartridge to operate in a third or fourth mode of operation based on the third or forth orientation. By having a single universal cartridge chip 700 used on both the HP4200 and HP4300 printer, the manufacturer may be able to stock one chip to allow the universal cartridge chip 700 to operate in a high yield or low yield mode of operation for the HP4200 or a high yield or low yield mode of operation for the HP4300 toner cartridges.

On the HP4200 or HP4300 toner cartridge, the universal cartridge chip 700 is mounted flush against a mounting surface (not shown). Because the integrated circuit 760 may extend away from the PCB 710, the mounting surface may need to be hollowed out should the universal cartridge chip 700 be installed with the integrated circuit 760 pressed against the mounting surface. The universal cartridge chip 700 may be installed with the integrated circuit 760 mounted against the HP4200 or HP4300 toner cartridge when contacts are positioned on the opposite side of the integrated circuit 760. Alternatively, the integrated circuit 760 may be designed such that it is relatively flush with the PCB 710.

In the HP4200 or HP4300 printer application, a slightly different modulation technique is used by the printer to communicate with the controller 410. In this instance, the I/O circuitry 420 decodes the modulated signals and feeds the signals into the orientation logic circuitry 430. The orientation logic circuitry 430 then determines which contacts 750 are conducting which signals. Based on which contacts 750 are conducting the particular signals, the controller 410 determines the orientation of the universal cartridge chip 700.

After the orientation is determined, the controller 410 may operate in one of a number of modes. The modes may be based on the print yield of the toner cartridge. For example, if the universal cartridge chip 700 is installed in a first orientation, the controller 410 may configure the toner cartridge 100 to operate in a first mode of operation corresponding to a low yield toner cartridge configuration. When the controller 410 configures the toner cartridge to operate as a low yield cartridge, the controller accesses a location in memory 430 corresponding to the low yield value. The controller 410 reads this value and sends the low yield value to the printer. The printer then allows the toner cartridge to operate as a low yield cartridge.

Alternatively if the controller 410 determines that the universal cartridge chip 700 is installed in a second orientation, the controller may configure the toner cartridge to operate in a second mode of operation corresponding to a high yield toner cartridge configuration. Similar to the process described for the low yield cartridge, the controller 410 may access a high yield location in memory 430. After reading the data in the high yield memory location, the controller 410 transmits this value to the printer. The printer reads the value and allows the toner cartridge to operate as a high yield cartridge.

In addition to the aforementioned imaging process cartridge types, the present invention may be applied to other printer models such as the HP3000, HP3600, HP3800 color printers or the HP1300, HP1320, HP2300 monochrome printers and the like.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of operating an imaging process cartridge installed in an imaging device, the imaging process cartridge having a universal cartridge chip, the method comprising:

determining a physical orientation of the universal cartridge chip when said universal cartridge chip is mounted on said imaging process cartridge, said universal cartridge chip mounted in a first position or a second position;

configuring said universal cartridge chip to operate in a first mode of operation if said universal cartridge chip is mounted in said first position; and, configuring said universal cartridge chip to operate in a second mode of operation if said universal cartridge chip is mounted in a second position.

2. The method of claim 1 wherein:

when operating in said first mode of operation, the universal cartridge chip returns a first value to the imaging device when a first memory location in the universal cartridge chip is accessed by the imaging device, the first value indicating that a first color of toner is held in the imaging process cartridge; and, when operating in said second mode of operation, the universal cartridge chip returns a second value to the imaging device when a second memory location in the universal cartridge chip is accessed by the imaging device, the second value indicating that a second color of toner is held in the imaging process cartridge.

3. The method of claim 1 wherein:

when operating in said first mode of operation, the universal cartridge chip returns a first value to the imaging device when a first memory location in the universal cartridge chip is accessed by the imaging device, the first value indicating that the imaging process cartridge is a high yield imaging process cartridge; and, when operating in said second mode of operation, the universal cartridge chip returns a second value to the imaging device when a second memory location in the universal cartridge chip is accessed by the imaging device, the second value indicating that the imaging process cartridge is a low yield imaging process cartridge.

4. The method of claim 1 wherein:

when operating in said first mode of operation, the universal cartridge chip returns a first value to the imaging device when a first memory location in the universal cartridge chip is accessed by the imaging device, the first value indicating that the imaging process cartridge is a low yield imaging process cartridge; and, when operating in said second mode of operation, the universal cartridge chip returns a second value to the imaging device when a second memory location in the universal cartridge chip is accessed by the imaging device, the second value indicating that the imaging process cartridge is a high yield imaging process cartridge.

5. The method of claim 1 wherein said universal cartridge chip determines if it is installed in the first orientation or second orientation based on communication information sent by said imaging device.

6. The method of claim 5 wherein said communication information is sent by said imaging device through electrical contacts positioned on said universal cartridge chip.

7. The method of claim 5 wherein said communication information further comprises pulse width modulated signals.

8. A universal cartridge chip comprising an input/output (I/O) circuit;

a controller coupled to said I/O circuit, said controller further comprising an orientation determination circuit wherein said orientation determination circuit receives communication information from said I/O circuit, said universal cartridge chip determining if it is installed in a first orientation or a second orientation based on said communication information.

9. The universal cartridge chip of claim 8 wherein said communication information further comprises modulated data and clock pulses.

10. The universal cartridge chip of claim 8 wherein said communication information is transmitted through electrical contacts positioned on said universal cartridge chip.

11. The universal cartridge chip of claim 8 further comprising a memory wherein imaging process cartridge data is stored in said memory, said imaging process cartridge data corresponding to the first mode of operation and said second mode of operation.

12. The universal cartridge chip of claim 8 wherein said universal cartridge chip operates in a first mode when said universal chip is installed in said first orientation.

13. The universal cartridge chip of claim 12 wherein said first mode of operation allows said imaging process cartridge to operate in a black toner cartridge location in a color imaging device.

14. The universal cartridge chip of claim 12 wherein said first mode of operation allows said imaging process cartridge to operate in a cyan toner cartridge location in a color imaging device.

15. The universal cartridge chip of claim 12 wherein said first mode of operation allows said imaging process cartridge to operate as a high yield toner cartridge when installed in an imaging device.

16. The universal cartridge chip of claim 12 wherein said first mode of operation allows said imaging process cartridge to operate as a low yield toner cartridge when installed in an imaging device.

17. An imaging process cartridge for use in an imaging device comprising:

a universal cartridge chip affixed on said imaging process cartridge, said universal cartridge chip having an orientation logic circuit, said imaging process cartridge operating in a first mode when said orientation logic circuit determines that the universal cartridge chip is mounted in a first orientation, said imaging process cartridge operating in a second mode when said when said orientation logic circuit determines the universal cartridge chip is mounted in a second orientation.

18. The imaging process cartridge of claim 17 wherein said first mode and said second mode correspond to a color of toner installed in the imaging process cartridge.

19. The imaging process cartridge of claim 17 wherein said first mode and said second mode corresponds to a print yield of the imaging process cartridge.

20. The imaging process cartridge of claim 17 wherein said universal cartridge chip determines if it is installed in the first orientation or second orientation based on communication information sent by said imaging device.

21. The imaging process cartridge of claim 20 wherein said communication information is sent by said imaging device through electrical contacts positioned on said universal cartridge chip.

22. The imaging process cartridge of claim 20 wherein said communication information further comprises pulse width modulated signals.

* * * * *